US005299524A

United States Patent [19]

Szilagyi

[11] Patent Number: 5,299,524

[45] Date of Patent: Apr. 5, 1994

[54] INFLATABLE KAYAK

[76] Inventor: Attila D. Szilagyi, P.O. Box 80, Albright, W. Va. 26519

[21] Appl. No.: 802,784

[22] Filed: Dec. 6, 1991

[51] Int. Cl.[5] ..... B63B 35/00

[52] U.S. Cl. ..... 114/345; 114/347

[58] Field of Search ..... 114/347, 345, 343, 352, 114/357; 441/40

[56] References Cited

U.S. PATENT DOCUMENTS

| | | | |
|---|---|---|---|
| 2,962,732 | 12/1960 | Marz | 114/347 |
| 4,057,865 | 11/1977 | Trautwein | 114/347 |
| 4,229,850 | 10/1980 | Arcouette | 114/347 |
| 4,589,365 | 5/1986 | Masters | 114/347 |
| 4,640,217 | 2/1987 | Ferronniere | 114/345 |
| 4,941,419 | 7/1990 | Corti | 114/345 |
| 4,961,397 | 10/1990 | Trone | 114/347 |

*Primary Examiner*—David M. Mitchell
*Assistant Examiner*—Stephen P. Avila

[57] ABSTRACT

The invention relates to inflatable kayaks, and more particularly, to hull designs for inflatable kayaks. The improved inflatable kayak of the invention includes a streamlined hull with no edges or corners which has three sections—a flat middle section, and two gradually curved end sections. The inflatable kayak of this hull design has improved speed, maneuverability, and tracking when compared to conventional inflatable kayaks.

6 Claims, 2 Drawing Sheets

INFLATABLE KAYAK

BACKGROUND OF THE INVENTION

The present invention generally relates to inflatable ships. More particularly, the invention relates to an inflatable kayak with a novel shape which provides improved performance. In particular, the improved inflatable kayak of the present invention provides superior performance in terms of maneuverability, tracking and speed over conventional inflatable kayak designs.

Inflatable kayaks provide several benefits over noninflatable kayaks made from wood or fiberglass. In particular, inflatable kayaks are more portable than noninflatable kayaks and are safer to use. These advantages of inflatable kayaks result from several design differences between inflatable and noninflatable kayaks.

For example, noninflatable kayaks have a solid shell which cannot be collapsed or folded for portability. While noninflatable kayaks are relatively lightweight their size makes transporting them difficult. In contrast, inflatable kayaks can be deflated and folded up to a relatively compact size for portability.

Further, noninflatable kayaks have a deck which completely covers the kayak except for a hole through which the user fits. The user's legs extend into the space between the hull of the kayak and the deck, and the user wears a tight fitting apron which is secured around the edge of the hole in the kayak deck. In contrast, an inflatable kayak has no deck. The user simply sits in the inflatable kayak with his legs extended forward. Consequently, inflatable kayaks are safer to use than noninflatable kayaks because the user is not enclosed within the body of the kayak if the kayak turns over in the water.

Nevertheless, conventional inflatable kayaks suffer from several disadvantages. Conventional inflatable kayaks are made from pieces of plastic material which are sealed together to form the body of the kayak. Generally, the pieces of plastic material are sealed by welding or gluing. Once assembled, the inflatable kayak includes one or more chambers which can be inflated to provide buoyancy.

Until recently, however, manufacturing technology limited the shape of inflatable kayaks due to limitations on the ability to form the various pieces of plastic material into certain shapes. In particular, the sealing technology used to make the seams between the plastic panels used to form inflatable kayaks was limited to butt welds, and butt welds could not be used to make seams which came to a sharp point. Consequently, the inflatable portions of these kayaks were cylindrical in shape with slightly rounded ends, and did not taper.

As a result of these limitations in manufacturing technology conventional inflatable kayaks had a three section hull design—a relatively long, straight middle section which was parallel to the long axis of the kayak, and two triangular end sections which angled upwards from the middle section. Consequently, conventional inflatable kayaks included two corners and an angled interface where each triangular end section intersected with the straight middle section. This nonstreamlined design impaired the performance of the inflatable kayak. In particular, the corners and angle at the intersection between the end sections and middle section of the kayak decreased its speed and maneuverability due to the drag created by the corners and angle.

Due to these disadvantages associated with conventional inflatable kayaks, a need exists for an inflatable kayak with performance comparable to noninflatable kayaks. In particular, the speed and maneuverability of inflatable kayaks should be improved without decreasing the portability or safety of inflatable kayaks.

SUMMARY OF THE INVENTION

The present invention provides an inflatable kayak with performance characteristics comparable to a noninflatable kayak. In particular, the inflatable kayak of the present invention includes an improved hull design which is more streamlined and has no corners or angles to reduce the speed or maneuverability of the kayak. More specifically, the hull of the inflatable kayak of the present invention has three sections—a short flat middle section and two curved end sections which gradually blend into the flat middle section.

The resulting hull shape is more streamlined than conventional inflatable kayaks and has no corners or edges which can create drag as the kayak moves through the water. In addition, the inflatable kayak of the present invention has a higher kick than other inflatable kayaks which provides superior performance in the kayak as it goes over falls and as it moves through waves. In sum, the inflatable kayak of the present invention eliminates the disadvantages associated with the hull shape of conventional inflatable kayaks.

DETAILED DESCRIPTION OF THE PREFERRED EMBODIMENTS

Figure 1:
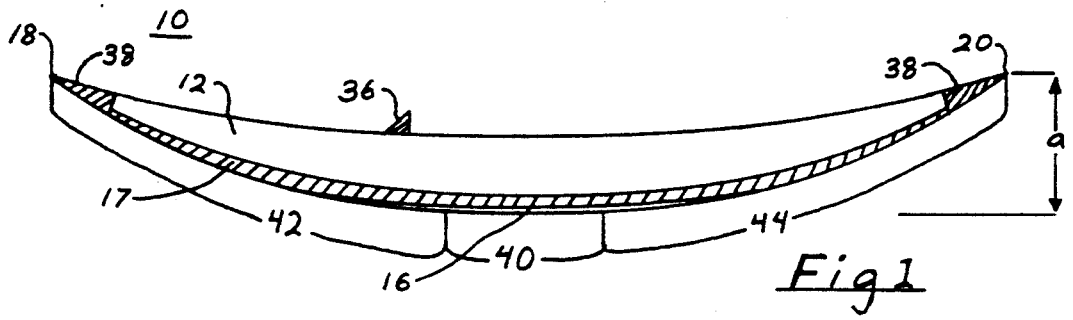
FIG. 1 depicts a side view of the inflatable kayak of the present invention showing the hull design.
Figure 2:
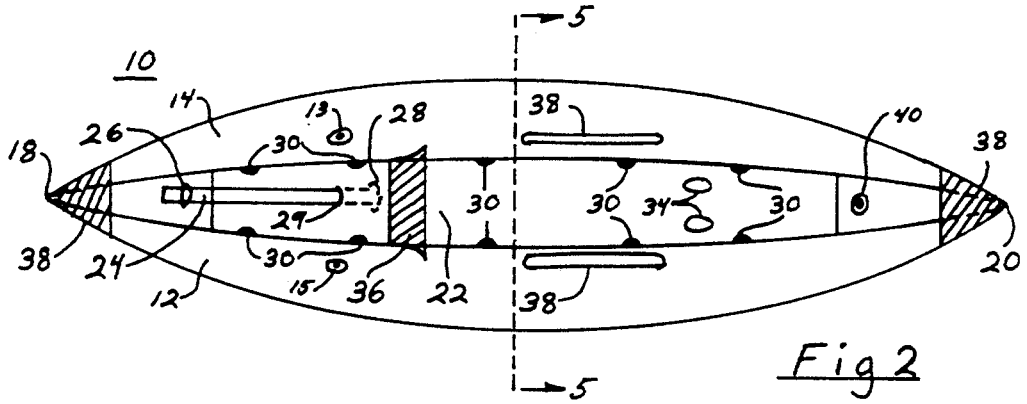
FIG. 2 depicts an overhead view of the inflatable kayak of the present invention.
Figure 3:
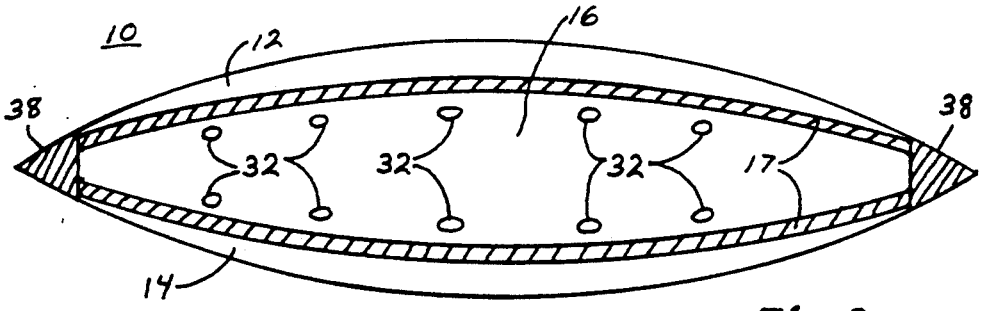
FIG. 3 depicts a bottom view of the inflatable kayak of the present invention.

Referring to FIGS. 1, 2, and 3, the inflatable kayak 10 of the present invention includes four basic parts. The first two parts are bouyant, inflatable tubes, 12 and 14, which form the sides of the inflatable kayak 10 of the present invention. The third part is a floor 16 which connects the two inflatable tubes 12 and 14. The fourth part is a stiffener board 22 which sits on the floor 16 of the kayak 10 between the two inflatable tubes 12 and 14.

The inflatable tubes, 12 and 14, are identical. Inflatable tube 12 has the shape of a cylinder which gradually tapers to points, 18 and 20, at either end. Inflatable tube 12 is curved so that the points, 18 and 20, are pointed together in the shape of a crescent. Inflatable tubes, 12 and 14, are generally about 12 feet long and about 11.5 inches in diameter at their widest point.

Inflatable tubes, 12 and 14, are made by welding together two identically shaped panels of a plastic material into a tube which has a sealable airtight internal cavity. Referring to FIG. 2, inflatable tubes, 12 and 14, include sealable ports, 13 and 15, through which pressurized air can be injected for inflating the tube. Alternately, the tubes, 12 and 14, could be made from a bouyant material which does not require inflation.

The plastic material used for making the inflatable tubes, 12 and 14, must be strong and pliable and resistent to abrasion and tearing. Preferably, a high quality vinyl material having a weight of 32 ozs/yd$^2$ is used for constructing the inflatable tubes. The remaining portions of the inflatable kayak such as the floor 16 are also made from the same plastic material It should be appreciated that other plastic materials could be used to make the inflatable kayak of the present invention so long as that plastic material had sufficient toughness and flexibility.

The vinyl panels are cut in the shape of a cross-section of the inflatable tubes, 12 and 14, which is taken through the plane of the inflatable tube that includes the long axis of the inflatable tube and also includes the two end points of the inflatable tube. Nevertheless, the vinyl panels for the inflatable tubes are somewhat wider than the inflated diameter of the inflatable tubes to account for the curvature of the tubes when inflated. The vinyl tube panels are cut from a pattern having the appropriate shape and dimensions.

Figure 4:
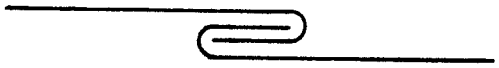
FIG. 4 depicts a cross-sectional view of the welds used on the inflatable kayak of the present invention.

The two vinyl panels are then welded together to form an inflatable tube using a "Vinyl Welder" machine which is especially made for welding plastic materials. Referring to FIG. 4, a folded overlapping weld is used for welding the vinyl panels together. This type of weld provides significant advantages over the butt welds used in conventional inflatable kayaks because it allows the formation of the tapered sharply pointed inflatable tubes that give the inflatable kayak of the present invention its unique hull design. Seams between the inflatable tubes and other parts of the inflatable kayak such as the floor are also sealed using this weld technique. Other methods such as gluing could be used for sealing the vinyl panels. Welding is preferred, however, because it generally provides a stronger seam than other sealing methods.

After the two inflatable tubes are formed, the floor 16 is attached to make the body of the inflatable kayak. First, the two inflatable tubes, 12 and 14, are positioned so that they are at the appropriate distance apart and the tips just touch at the ends. The distance between the two inflatable tubes is determined based on the width of the hips of the person who will use the inflatable kayak or could be based on a predetermined, standard width as desired. Generally the width ranges from 11 to 18 inches at the widest separation between the tubes. In this orientation the inflatable tubes are positioned so that their tips are angled toward each other. The amount of angle determines the kick of the inflatable kayak. The more the tips of the inflatable tubes are pointed vertically the greater the kick, and the less the tips are pointed vertically the less the kick of the inflatable kayak. Preferably, the inflatable tubes are tilted so that their tips are at an angle which is about 45 degrees from vertical. This results in a kick ranging from 19 to 21 inches as shown by the measurement "a" in FIG. 1.

A vinyl panel is cut to form the floor 16 between the two inflatable tubes 12 and 14. In particular, the floor 16 is made from the same vinyl material that is used for the inflatable tubes, 12 and 14. The floor 16 is cut to fit between the mid-lines of the bottoms of each of the two inflatable tubes, 12 and 14, and runs the length of the inflatable tubes. A pattern is created for the floor 16 just like for the panels used to make the inflatable tubes, 12 and 14. The floor 16 is the same length as the inflatable tubes, 12 and 14, and ranges from about 22 to 30 inches wide at the widest point of the inflatable kayak. The vinyl panel for the floor 16 is welded to the bottoms of the inflatable tubes, 12 and 14, using the same welding technique that is used to weld the inflatable tubes.

Preferably, wear strips 17 are provided over the seams between the floor 16 and the inflatable tubes, 12 and 14. The wear strips 17 consist of an additional piece of the vinyl which is about 3.5 inches wide and runs the length of the inflatable tubes, 12 and 14. The wear strip provides protection for the seam between the floor 16 and the inflatable tubes, 12 and 14, and prevents tears and rips which might occur due to abrasion and contact with rocks and other subsurface obstructions in water.

Referring to FIG. 2, a stiffener board 22 is included in the bottom of the inflatable kayak 10 to protect the user of the kayak from rocks and other obstructions when the kayak is being used. In addition, the stiffener board 22 provides increased buoyancy and structural stability for the kayak 10. The stiffener board 22 is made from a relatively light weight, solid material which has good resiliency and abrasion resistance. Preferably, the stiffener board 22 is made from expanded polyethylene.

The stiffener board 22 ranges from about 2 to 6 inches in thickness and extends for most of the length of the inflatable kayak 10. Further, the stiffener board 22 is slightly wider than the distance between the inner edges of the inflatable tubes, 12 and 14, and tapers towards its ends so that it fits snugly between the floor 16 and the inflatable tubes, 12 and 14. In addition, referring to FIG. 5, the sides of the stiffener board taper from bottom to top so that it will fit snugly in the angle formed between the floor 16 and the inflatable tubes, 12 and 14.

The stiffener board 22 is held to the floor 16 of the inflatable kayak 10 by means of a strap 24 which is attached to the floor 16 of the inflatable kayak 10 at points 26 and 28. Point 26 is located at one end of the stiffener board 22 and point 28 is located under the stiffener board 22. The stiffener board 22 includes a slot 29 through which the strap 24 passes before the strap 24 attaches to the points, 26 and 28, in a conventional manner.

The inflatable kayak 10 additionally includes end covers 38 which cover the points of the inflatable tubes 12 and 14 at either end of the kayak. The end covers 38 provide structural support for the inflatable kayak 10 by holding the inflatable tubes, 12 and 14, together. In addition, the end covers 38 help to prevent water from entering the kayak at the ends. Each end cover 38 is made from a single piece of the same vinyl used in the inflatable tubes, 12 and 14, and is welded to form the cover. The end covers 38 are then glued into place on the ends of the kayak 10 and coated with urethane for extra protection.

The stiffener board 22 includes multiple bailing channels 30 which correspond to bailing holes 32 (see FIG. 3) provided in the floor 16 of the inflatable kayak 10. In this manner, water which enters the inflatable kayak 10, drains quickly through the bailing channels 30 and out of the bailing holes 32 in the floor 16. It should be appreciated that the buoyancy of the inflatable tubes, 12 and 14, and stiffener board 22 prevents water from flowing into the kayak and possibly swamping it through the bailing holes 32 and bailing channels 30.

The stiffener board 22 preferably includes two foot holes 34 for the heels of the user. The foot holes 34 allow the user to secure his feet and provide leverage for paddling by the user. In addition, the kayak 10 includes a back support 36 for the user. The back support 36 is located so that the user is centered in the kayak 10, and the back support 36 is inflatable like the inflatable tubes, 12 and 14. The back support 36 is made by welding together one folded piece of the same vinyl used for the inflatable tubes, 12 and 14, and floor 16 of the kayak 10, and is curved to more comfortably fit the user. The back support 36 is glued to the sides of the inflatable tubes, 12 and 14, to hold it in place.

Leg straps 38 are provided on each side of the inflatable kayak 10 to secure the legs of the user in the kayak. Each leg strap 38 is a band with its ends glued to the inside surface of an inflatable tube. The leg straps 38 are positioned so that when the user is seated in the kayak, his knees can be inserted into the space between the leg straps and the inflatable tubes, 12 and 14, by bending his knees and inserting his heels into the holes 34 provided in the stiffener board 22. In this manner, the user's legs are secured by the leg straps 38. Nevertheless, the user can easily avoid the leg straps 38 by simply removing his heels from the holes 34 in the stiffener board and straightening his legs which removes his knees from between the leg straps and the inflatable tubes.

Preferably, a carabiner clip 40 is attached to the floor 16 of the kayak 10 at one end for convenience. This clip 40 is useful for attaching objects to the kayak and also for removing the kayak from positions where it has become stuck.

The length and width of the inflatable kayak of the present invention is pre-determined for each particular user. In the alternative, a conventional length and width could be selected which would fit most users for the inflatable kayak. In general, an inflatable kayak of the present invention designed for a single adult user is about 12 feet long and 32 to 38 inches wide at its widest point. An inflatable kayak of the present invention designed for a child would be about 9 feet long and narrower than the adult version. Likewise, an inflatable kayak of the present invention designed for two would be longer than 12 feet but about the same width as the single adult kayak.

The performance of the inflatable kayak of the present invention is dependent upon the shape and geometry of the hull of the kayak. Consequently, the hull of the inflatable kayak of the present invention has been carefully designed to maximize the performance of the kayak. Generally, the hull has been streamlined to remove any corners and edges. This reduces drag and improves the ability of the kayak to move through water. In addition, streamlining the hull increases maneuverability of the kayak.

In particular, referring to FIG. 1, it can be seen that the hull of the inflatable kayak 10 of the present invention consists of three sections—a flat middle section 40 and two curved end sections, 42 and 44. The flat middle section 40 and end sections, 42 and 44, gradually merge into each other with no sharp edges or corners. The flat middle section 40 extends about 9 inches on either side of the mid-point of the kayak 10 for a total length of 18 inches. It should be appreciated that the hull of the improved inflatable kayak is defined as the flat middle section and two curved end section. Consequently, the hull includes only the bottom water contacting surfaces of the improved inflatable kayak, and does not include the tips of the kayak or any edges or corners which are located on the top portion of the improved inflatable kayak.

The end sections, 42 and 44, of the inflatable kayak gradually curve from the flat middle section 40 to the ends of the kayak 10. In particular, the end sections, 42 and 44, are formed in the shape of a segment from an ellipse. An ellipse is a flattened circle, and can be defined by a major axis which represents the longest line between two points on the ellipse, and a minor axis which represents the shortest line between two points on the ellipse. The end sections, 42 and 44, of the inflatable kayak 10 of the present invention are shaped as the segment of an ellipse starting from the intersection of the minor axis and the ellipse and extending along the ellipse towards the intersection of the major axis with the ellipse, but leaving out the highly curved portion of the ellipse that is nearest the intersection of the major axis and the ellipse. The exact curvature of this portion of the hull of the inflatable kayak of the present invention is not critical but should generally represent the segment of an elliptical curve as described and should not be too curved at the end of the kayak. It is more important that the length of the flat middle section of the inflatable kayak be maintained and that an appropriate kick be provided.

Figure 5:
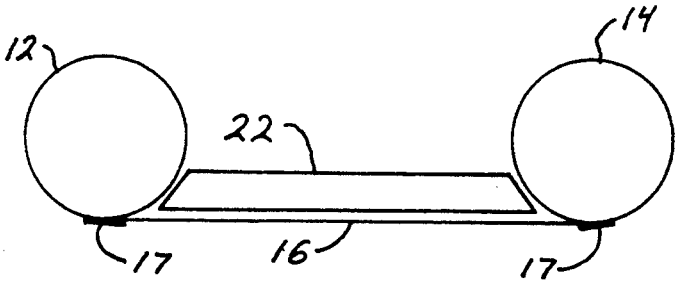
FIG. 5 depicts a cross-sectional view of the hull of the present invention along section line b—b from FIG. 2.

Referring to FIG. 5, it can be seen that a cross-section of the hull of the inflatable kayak of the present invention is flat on the bottom and curves in a half-circle on either end. The flat portion of the cross-section is formed by the floor 16, and the half circles are formed by the inflatable tubes, 12 and 14. The shape of the cross-section is maintained along the length of the kayak 10 but decreases in size towards the ends of kayak.

The shape and geometry of the hull, as described above, is primarily determined by the shape of the inflatable tubes, 12 and 14, when inflated. In particular, the vinyl panels used to make the inflatable tubes, 12 and 14, are patterned to have a flat middle section and curved end sections corresponding to the desired shape of the hull of the kayak.

The flat middle section of the kayak 10 provides the most significant performance improvement. In particular, the flat middle section provides better tracking for the kayak by keeping the kayak moving in a straight line as opposed to a side-to-side waffling motion that is caused by alternate paddling on either side of the kayak. This makes paddling of the boat significantly easier and also improves the speed of the boat due to the elimination of the slight changes in direction that would otherwise occur.

In this context, it should be appreciated that the maneuverability of the kayak is its ability to change directions due to the use of the paddle of the user. Further, the ability of the kayak to track represents the resistance of the kayak to changes in its orientation due to the normal movement of the kayak from alternate paddling by the user first on one side and then the other side—i.e., the ability of the kayak to move in a straight line as it is alternately paddled on either side.

In addition, the overall shape of the inflatable kayak effects some performance characteristics of the kayak. In particular, the kick of the kayak is significant to the performance of the kayak because it determines the ability of the kayak to move through waves or rough water and also the ability of the kayak to deflect and stay on top of the water when it comes over falls. The kick of a kayak is the height of the end of the kayak. The kick of the kayak of the present invention is sufficiently high in combination with the hull curvature to let the kayak penetrate waves and to avoid submerging when going over falls.

EXAMPLE 1

A first attempt was made to overcome the drawbacks of conventional inflatable kayaks by eliminating the corners and angled hull surface formed by the long, flat middle section and two triangular end sections of those inflatable kayaks. That attempt involved deleting the corners and angled hull surface by providing a completely curved hull design. This design was superior in performance to conventional inflatable kayaks. Nevertheless, it still had serious performance flaws. For example, it did not track when paddled—i.e., it tended to waffle from side-to-side when it was alternately paddled on each side. Further, due to the complete curvature of the hull in that design, the hull did not have a sufficient water contact area which resulted in decreased speed and loss in maneuverability. In addition, the pointed stern of that inflatable kayak was somewhat rounded relative to the pointed bow. This lack of symmetry also reduced the performance of that inflatable kayak.

EXAMPLE 2

A second attempt was made to correct the drawbacks of conventional inflatable kayaks while avoiding the problems of the first attempt. In particular, the hull was modified to provide more water contact area. This was accomplished by flattening out the curve in the hull of the kayak and also lengthening the kayak. These design changes improved the performance of the second attempt as compared to the first attempt by increasing the maneuverability of the kayak. Nevertheless, the second attempt still suffered from performance problems—i.e., it was too slow and it still tended to waffle from side-to-side as the kayak was alternately paddled on each side.

EXAMPLE 3

The third attempt to overcome the disadvantages of conventional inflatable kayaks while avoiding the problems associated with the first and second attempts was successful and represents the inflatable kayak of the present invention. In particular, the hull design of the third attempt was modified from the hull design of the second attempt by providing a flat section in the middle of the hull. Moreover, the kick of the inflatable kayak was increased by increasing the curve of the curved sections of the hull.

The modifications to the hull of the inflatable kayak had significant advantages over the previous attempts. In particular, the flat middle section of the hull increased the speed of the inflatable kayak and provided better tracking—i.e., the ability of the kayak to resist side-to-side waffling due to alternate paddling of the inflatable kayak on each side.

In addition, the higher kick of the inflatable kayak of the present invention eliminated problems relating to the tendency of the first and second kayak to take on water and go under water when cresting waves and going over water falls. The hull of the kayak of the present invention has sufficient curve that when the point of the kayak hits the water after it has gone over a falls it tends to deflect horizontally and prevent the kayak from penetrating the water. The inflatable kayak of the present invention has competed and performed equally to noninflatable kayaks by finishing eighteenth in a whitewater race against 60 kayaks most of which were noninflatable kayaks. This accomplishment would be impossible for conventional inflatable kayaks.

It should be appreciated that the inflatable kayak of the present invention and its corresponding advantages will be understood from the detailed description and examples provided above. Nonetheless, the detailed description and examples provided above are merely illustrative of the claimed inflatable kayak, and variations and changes could be made to the form, construction, and arrangement of the parts of the inflatable kayak without departing from the spirit and scope of the invention as claimed.

What is claimed is:

1. A kayak for floating on the surface of a body of water comprising:

a pair of parallel cylindrical buoyant tubes, each said tube consisting essentially of a middle part with a constant diameter and two end parts which gradually taper to a point, said end parts of each said tube bending slightly towards each other so that each said tube forms a shallow arc, said tubes oriented so that said points on corresponding end parts of said tubes meet;

a floor, said floor interconnecting said pair of tubes to form a hull, said hull having a smooth continuous surface without any corners or edges contacting the surface of the body of water, said hull surface consisting essentially of a flat middle section and two curved end sections, wherein said curved end sections represent a segment taken from an ellipse starting at the point where the minor axis of the ellipse intersects the ellipse and extending to the point where the major axis of the ellipse intersects the ellipse without including the highly curved portion of the ellipse nearest the intersection of the major axis and the ellipse whereby said inflatable kayak has minimal drag and improved tracking when moving across the surface of the body of water;

a buoyant stiffener board attached to said floor between said buoyant tubes; and a plurality of bailing holes located in said floor with corresponding bailing channels located in said buoyant stiffener board which are effective for quickly draining water from said kayak.

2. The kayak recited in claim 1 comprising two end covers, each said end cover covering an end of said kayak.

3. The kayak recited in claim 1 comprising a back rest, said back rest located between said tubes so that a user is centered in the kayak, said back rest being effective for supporting the back of the user of said kayak.

4. The kayak recited in claim 1 comprising a pair of leg straps, each said leg strap attached to one of said tubes, said leg straps effective for securing the legs of a user of said kayak.

5. The kayak recited in claim 1 comprising a clip attached to said floor of said kayak.

6. The improved kayak recited in claim 1 wherein said hull of said kayak is symmetrical about the kayak's longitudinal and transverse axes.

* * * * *